United States Patent [19]

Renton et al.

[11] 4,093,521

[45] June 6, 1978

[54] CHROMIUM ELECTROPLATING

[76] Inventors: Stanley Renton, 6 Kenilworth Close, Penkridge, Staffordshire; John Cooper Crowther, 14 Gilbanks Road, Stourbridge, West Midlands, both of England

[21] Appl. No.: 810,744

[22] Filed: Jun. 28, 1977

Related U.S. Application Data

[63] Continuation-in-part of Ser. No. 751,376, Dec. 17, 1976, abandoned.

[30] Foreign Application Priority Data

Dec. 18, 1975 United Kingdom ..... 51798/75
Feb. 26, 1976 United Kingdom ..... 07595/76

[51] Int. Cl.[2] ..... C25D 3/06; C25D 3/56
[52] U.S. Cl. ..... 204/43 R; 204/51
[58] Field of Search ..... 204/43 R, 43 T, 51

[56] References Cited

U.S. PATENT DOCUMENTS

| | | | |
|---|---|---|---|
| 2,693,444 | 11/1954 | Snavely et al. | 204/43 R |
| 2,822,326 | 2/1958 | Safranek | 204/43 R |
| 2,927,066 | 3/1960 | Schaer | 204/43 R |
| 2,990,343 | 6/1961 | Safranek | 204/43 R |
| 3,111,464 | 11/1963 | Safranek et al. | 204/43 R |
| 3,954,574 | 5/1976 | Gyllenspetz et al. | 204/43 T |
| 4,054,494 | 10/1977 | Gyllenspetz et al. | 204/43 T |

*Primary Examiner*—G. L. Kaplan
*Attorney, Agent, or Firm*—Flynn & Frishauf

[57] ABSTRACT

Improved trivalent chromium electroplating baths containing from about 30 to about 150 parts per million of iron or nickel content, or from about 30 to about 150 parts per million of iron plus nickel with the nickel in an amount up to about 100 parts per million.

7 Claims, No Drawings

CHROMIUM ELECTROPLATING

This application is a Continuation-In-Part Application of Application Ser. No. 751,376 filed Dec. 17, 1976, now abandoned.

The present invention relates to chromium electroplating. In particular it relates to electroplating from aqueous trivalent chromium plating baths.

The potential value of solutions containing trivalent chromium as electrolytes for chromium plating has been recognised for many years. However, practical difficulties have, until recently, prevented the commercial introduction of any decorative chromium electroplating system based on trivalent chromium. All commercial decorative chromium plating has been based on hexavalent chromium, which has some very serious drawbacks. Recently, however, certain significant advances have been made in respect of trivalent chromium plating compositions, in particular a composition containing formate and/or acetate, bromide and ammonium as complexing agents described and claimed in U.S. Pat. No. 3,954,574 which has had substantial commercial success.

In practice, the decorative appearance of deposits obtained from the aforesaid trivalent chromium plating baths may sometimes be marred by certain faults such as streakiness, haze or bands at certain current densities. In Belgian Pat. No. 843,713 (which corresponds to U.S. application Ser. No. 702,374 filed July 2, 1976), there are described certain faults which, it has been discovered, are due to the presence in the electrolyte of traces of metals such as cobalt, copper, zinc and nickel which sometimes contaminate chromium plating baths. We have now found that even when these metals are substantially eliminated from the electrolyte, a slight greyish discolouration of the deposits at high current densities is observed. Surprisingly we have now discovered that an improved deposit may be obtained when the solution contains very small traces of certain metals, within a particular range of concentration.

While it is known that metals such as iron, cobalt and nickel can be added to certain chromium plating solutions in order to plate out alloys of such metals with chromium, we have found that most such metals cannot be co-deposited with chromium from solutions according to said U.S. Pat. No. 3,954,574 to form alloys containing substantial amounts of the minor component. Nickel and cobalt for example both cause serious plating faults when present in more than trace amounts, and fail to form acceptable alloy deposits.

Iron, in the absence of other trace metals forms an alloy deposit with chromium, but it is generally undesirable to form such deposits because their properties, particularly with regard to corrosion resistance, are inferior to those of chromium. It has therefore been considered necessary to prevent any accumulation of iron in the plating solution. Surprisingly we have found that traces of iron so small as to form a deposit which is, for practical purposes, a chromium deposit rather than an alloy deposit, can inhibit the aforesaid greyish discolouration, as can traces of nickel which are too small to cause plating faults.

Our invention provides a trivalent chromium electroplating bath containing a trivalent chromium salt, a formate and/or acetate, a bromide, and ammonium, e.g. substantially as described in the specification of said U.S. Pat. No. 3,954,574, but which additionally contain metals selected from (i) from 30 to 150 ppm of iron or nickel, or (ii) from 30 to 150 ppm of iron plus nickel with the nickel being in an amount up to about 100 ppm.

Preferably baths according to our invention contain a borate, such as sodium borate or boric acid, chloride and/or sulphate, and alkali metal such as sodium or potassium. Customarily a wetting agent is also included. Baths according to our invention are preferably substantially free from hexavalent chromium. Typically they have a pH of between 1 and 4.

The solution may contain bromide, formate (or acetate) and any borate ion which may be present, as the sole anion species, but such solutions are undesirably expensive. Preferably, therefore the solution contains only sufficient bromide to prevent substantial formation of hexavalent chromium, sufficient formate to be effective in complexing the chromium and sufficient borate to be effective as a buffer, the remainder of the anions required to balance the cation content of the solution comprising cheaper species such as chloride and/or sulphate.

For example the solution optionally and preferably contains halide ions in addition to bromide, such as fluoride, or preferably, chloride. The total amount of halide including the bromide and any iodide which may be present as well as any fluoride, and/or chloride may optionally be sufficient, together with the formate and any borate to provide essentially the total anion content of the solution. The latter is determined by the number of equivalent of cation (including hydrogen ion) and is typically from 4 to 6 molar. Alternatively, and preferably, there may additionally be present some sulphate ion. In one embodiment, the sulphate is present in a minor proportion based on the halide, e.g. a minor proportion based on the chloride and/or fluoride. Alternatively the sulphate may comprise a major proportion of the inorganic ion and, less preferably, may be present in place of chloride and fluoride. Preferably the solution also contains alkali metal ions, usually provided as the cations of the conductivity salts, and/or of some or all of the salts used to introduce the anion species, which alkali metals are preferably sodium or potassium. The solution may also contain alkaline earth metals such as calcium or magnesium.

The solutions of our invention may additionally contain minor, compatible amounts of additives, such as wetting agents (e.g. alkali metal alkyl benzene sulphonates) or antifoams which are commonly used in plating technology.

Our novel solutions may therefore comprise some of the following species:

A. Trivalent Chromium

This is an essential ingredient of all the solutions of the invention. Proportions of less than 0.1 molar or more than 1.2 molar trivalent chromium result in significant loss of covering power, and the concentration is preferably between 0.2 and 0.6 molar. Preferably the solution is substantially free from hexavalent chromium and preferably the chromium in the solution is substantially all present as trivalent chromium before plating.

B. Bromide

This is an essential ingredient. The concentration of bromide should preferably be maintained above 0.01 molar, to avoid formation of hexavalent chromium, and lowering of the plating rate. The maximum concentration is not crucial, but is typically less than 4 molar and preferably less than 1 molar. Economic and effective operation normally requires a concentration of bromide between 0.05 and 0.5. The preferred range is from 0.05 and 0.3 molar. Best results are obtained when the concentration of bromide is greater than 0.1 molar. Iodide functions in a similar fashion to bromide, but suffers from the disadvantage that free iodine, which would be formed during plating is only soluble to the extent of 0.03% w/w in water compared with 4% for bromine. Consequently attempts to use iodide in place of bromide lead to unacceptable precipitation of iodine. Iodide, is moreover, too expensive to use economically in place of bromide. However, it is possible, in principle, to replace a minor part of the bromide with iodide, and references herein to bromide do not exclude bromide containing traces of iodide.

C. Formate or Acetate

This is an essential ingredient, formate or mixtures of formate with acetate being most strongly preferred. Typically the proportion of formate or acetate to chromium should not exceed 3 : 1 on a molar basis, to avoid unacceptably severe precipitation of the corresponding chromium salt. If the proportion is less than 0.5 : 1 the covering power is undesirably reduced. Preferably the proportion of formate to chromium is between 2 : 1 and 1 : 1. Acetate functions similarly to formate but gives a very much lower plating speed. Acetate alone is not as effective as formate in preventing the accumulation of free halogen. It is possible, however, to use acetate as a partial replacement for formate up to about a third of the total weight of carboxylic acid without serious adverse effect. A preferred bath, useful for the present invention, is described in U.K. Specification No. 35158/76, filed 24th August 1976. The preferred bath contains from 0.1 to 1.2 moles per liter trivalent chromium, from 1 to 3 moles formate per mole of chromium from 0.1 to 0.5 moles acetate per mole of formate, at least 0.05 moles per liter bromide and at least 0.05 moles per liter ammonia.

E. Ammonia

The presence of ammonium is essential for our invention. Generally if the concentration of ammonium is less than 0.1 molar, there is a severe reduction of covering power at high current density. The upper limit is not critical and ammonium may be present in amounts of up to saturation, i.e. about 4 molar. Preferably the ammonium is present in a concentration of at least 0.2 molar, most preferably from 1 to 3 molar. These higher concentrations are desirable because deposits tend to be darker at ammonia concentrations near the minimum and also because the presence of ammonium helps to reduce consumption of formate. Both ammonium and formate contribute to preventing the buildup of free bromine, but at higher ammonium concentration, the proportion of ammonium oxidised in this reaction is greater, with consequent economies in the more expensive formate. It is also possible, though not preferred, within the scope of this invention to include some substituted ammonium compounds such as hydroxylamine, hydrazonium or alkylammonium in the compositions. However, in the absence of ammonium itself they do not provide adequate covering power. Preferably arylammonium or heterocyclic ions such as pyridinium are absent since they tend to inhibit deposition of chromium.

F. Borate

Although it is possible to plate chromium from solutions of our invention which do not contain borate, we have not been able to obtain what we consider fully satisfactory results, commercially, in the absence of borate. Concentrations below 0.1 molar result in undesirably low covering power. The upper limit is not critical and is determined only by the solubility of borate in the system, but generally we prefer to employ from 0.5 to 1 molar borate. The function of the borate is obscure. Its beneficial effects may be in part due to its buffering action. However, other buffer salts, such as phosphates and citrates appear relatively ineffective.

G. Conductivity Salts

These are optional but generally preferred. The concentration is not critical and may vary between zero and about 6 molar according to solubility. Preferably they are present in proportions between 0.5 and 5 molar, e.g. 1 to 4 molar. Conductivity salts is a term used in the plating art to denote certain readily ionisable salts which may be added to plating baths to increase their electrical conductivity and so reduce the amount of power dissipated in the bath. Typically they are alkali metal or alkaline earth metal salts of strong acids which are soluble in the solution. They should have a dissociation constant at least equal to $10^{-2}$. Typical examples are the chlorides and sulphates of sodium and potassium.

H. Hydrogen Ion

Best results are obtained when the bath is somewhat acidic. At low pH values (below 2) there is some loss of covering power which becomes unacceptable below pH 1. If the pH is above 4 the rate of plating tends to be undesirably slow. Optimum pH is between 2 and 3.5.

I. Chloride and/or Fluoride

This is optional, but at least in the case of chloride, preferred. The amount is not, however, critical. It may vary from zero up to the maximum permitted by solubility considerations. Chloride is generally introduced into the bath as the anion of the conductivity salt (e.g. sodium chloride), as ammonium chloride, which is a convenient means of introducing the ammonia requirement of the bath, as chromic chloride which may optionally be used to supply at least part of the chromium requirement, and/or as hydrochloric acid, which is a convenient means of adjusting the pH of the bath. Preferably the chloride content is at least 1 molar e.g. 1.5 to 5 molar. A particularly convenient range is 2 to 3.5 molar.

J. Sulphate

This is an optional but preferred ingredient. The amount of sulphate is not critical and may, like that of the chloride, vary between zero and maximum amount which is compatible with the solution. In one type of bath the amount of sulphate is less than the total chloride. In a different type of bath, however, the proportion of sulphate is greater than the proportion of halide, and may be the predominant anion in the bath. Like the chloride, the sulphate may be introduced into the bath as the anion of the conductivity salt, or of the ammonium or chromium salts or as sulphuric acid. Particularly preferred is the use of sulphate as the source of chromium in the form of chrome tanning liquors which are a basic chromium sulphate and which, being a commercial by-product are a particularly convenient and cheap source of trivalent chromium. Typical sulphate concentrations may be between 0 and 5 molar preferably 0.5 to 4, e.g. 0.6 to 3, most preferably 0.6 to 1.2 molar. Preferably the combined chloride and sulphate concentrations are at least 1 molar, e.g. at least 2 molar most preferably from 2.5 to 4 molar.

K. Trace Metals

These are an essential ingredient of the bath in the case of iron and/or nickel to obtain the benefits of the present invention. Iron and/or nickel are present in the bath in a concentration of from 30 to 150 ppm total. Where the bath contains a substantial proportion of iron the amount of nickel should not exceed 100 ppm. Manganese may be present without adverse effect in proportions up to about 1,000 ppm. Iron and/or nickel are normally introduced as their soluble chlorides or sulphates. Other trace metals such as cobalt, zinc, and lead are preferably present in proportions of less than 20 ppm each and more preferably less than 30 ppm total. Concentrations of nickel higher than the above stated maxima cause plating faults and large excesses may render the solution totally inoperative. The presence of iron alone does not cause any visible plating fault. However, iron tends to codeposit with the chromium. If the iron exceeds about 150 ppm there is a substantial risk that the iron content of the deposit will be high enough to affect its properties adversely. Cobalt, zinc, copper and lead cannot be tolerated in the bath in significant amounts.

L. Alkali or Alkaline Earth Metals

These are optionally but preferably present. In particular it is preferred to include alkali metals and especially sodium and/or potassium in the bath in a proportion of at least 0.5 molar up to 4 or 5 molar according to solubility. The presence of sodium and/or potassium helps the conductivity of the solution and also improves the throwing power. Typically the sodium and/or potassium are added in a proportion of about 2 molar initially, but tend to accumulate during use so that the concentration may rise to saturation value. Other alkali metals such as lithium, alkaline earth metals such as calcium or magnesium or other metal ions which will not plate out of the solution with the chromium may also be present. The amount of such metals may vary within very wide limits provided that they do not precipitate in the presence of the other components. They are generally present incidentally, as the cation species of the conductivity salt, or of the borate, formate and/or bromide salts which may be used to provide those anions species in the solution.

M. Surface Active Agents

These are optionally but preferably present in effective and compatible amounts. Wetting agents and antifoams are used throughout plating technology and many suitable examples are well known to those skilled in the art. Any of the wetting agents commonly used in hexavalent chromium plating may be used in the present invention. However, since the solutions of the present invention are much less strongly oxidising than hexavalent chromium solutions it is possible, and preferred, to use the cheaper wetting agents commonly employed in the less aggressive types of plating solution. The principal restriction on the effectiveness of the wetting agents arises from the presence of the free bromine in the solution. Surfactants which are liable to bromination are therefore not recommended e.g. most non-ionic surfactants. The surfactants used according to our invention are typically cationic such as those described in B.P. No. 1,368,749 or preferably anionic e.g. sulphosuccinates, alkyl benzene sulphonates having from 8 to 20 aliphatic carbon atoms, such as sodium dodecyl benzene sulphonate, alkyl sulphates having from 8 to 20 carbon atoms such as sodium lauryl sulphate and alkyl ether sulphates such as sodium lauryl polyethoxy sulphates. If the solution has undesirable foaming tendencies it is also possible, optionally, to include compatible antifoams e.g. fatty alcohols such as cetyl alcohol. The choice of surfactants for use in our solution is a routine matter easily within the ordinary competence of those skilled in the art. The amount of wetting agent used is in accordance with normal practice, e.g. 0.1 to 10 parts per thousand.

It is preferred that the solutions of our invention should consist essentially of the foregoing species. However, we do not exclude the presence or minor amounts of other species which are compatible with the solutions and which do not adversely affect the plating properties to a material extent. Generally it is preferred that nitrate ion be substantially absent, since it tends to inhibit deposition of chromium. Sulphite ion also is preferably absent, since it can cause hazy deposits in more than very small amounts. Other species, organic or inorganic, which do not inhibit plating of the chromium or materially reduce covering power or create unacceptable problems of toxicity, may optionally be present. Whether any particular species can be tolerated in the solution may be routinely determined by simple testing.

According to the present invention the baths are preferably made up substantially as described in any of the aforesaid specifications but including from 30 to 150 ppm of iron and/or nickel in the solution. Preferably the additional metal is iron, most preferably ferric iron. Conveniently a sufficient quantity of an appropriate salt, e.g. ferric chloride, or preferably ferric sulphate is added to the bath at any convenient stage in the preparation thereof. Alternatively the iron may be introduced in admixture with any of the other components of the bath. For example, it is possible to select a source of one of the other bath components, such as chromic sulphate, which contains iron as an impurity, in sufficient quantity to provide the necessary concentration in the bath. Preferably, when replenishing the bath, iron, or nickel, is included in the replenishing additions in a quantity sufficient to maintain the concentration within the specified limits. Preferably the concentration is 40 to 100 ppm e.g. 50 ppm. If the concentration of iron and/or nickel should greatly exceed the specified limits, thus resulting in a plating fault, it may be reduced by addition to the bath of a hexacyano-ferrate salt, substantially as described in the specification of the aforesaid Belgian Patent, but ensuring that after treatment the concentration of the aforesaid metals is adjusted as necessary to bring it within the concentration limits characteristic of this invention.

The invention is illustrated by the following examples:

1. A chromium plating solution was prepared containing 20 gpl chromium, the chromium being supplied from commercial chromic sulphate, and 32 gpl formic acid, the other constituents being potassium chloride (75 gpl), boric acid (50 gpl), ammonium bromide (10 gpl) and ammonium chloride (90 gpl) as described in our aforesaid U.S. Patent. After preparation and plating out at 0.5 amps per liter for 60 minutes a Hull Cell panel was run on the solution at 10 amps for 3 minutes. At current densities in excess of 400 ASF grey bands could be detected. Analysis of the solution for trace elements showed 15 ppm iron, 10 ppm nickel and 1 - 2 ppm of copper and zinc, these metals having arisen from traces present in the commercial grades used.

25 ppm of iron was added as ferric chloride ($FeCl_3 6H_3O$) (i.e. 0.120 g per liter) and the solution re-run on the Hull Cell. The grey bands had disappeared and a clean non-banded panel was obtained. The final analysis of the solution was 40 ppm iron, 10 ppm nickel, 5 ppm (Cu + Zn).

2. A working solution made up as above and used for production became contaminated with nickel and iron, leading to a plating fault. Analysis of the solution confirmed 110 ppm Fe, 150 ppm Ni, 25 ppm Zn, 5 ppm Cu. The solution was treated with tetra-potassium hexacyanoferrate ($K_4Fe(CN)_6$) at the rate of 1 ml/liter of a 20% w/v solution per 50 ppm metals i.e. 6 ml/l. After allowing time for the reaction to reach completion the precipitated metals were filtered off and the solution re-analysed. Results were 20 ppm Fe, 15 ppm Ni, showing virtually complete removal of metals. A Hull Cell panel showed a trace of grey bands beginning to develop at high current densities and work plated in the electrolyte showed a faint greyish appearance at very high current density points. 25 ppm iron (as $FeCl_3 6H_2O$) was added to the electrolyte, when the grey bands and the grey marks on work immediately disappeared. The concentration of (nickel + iron) was maintained in the concentration range 40 to 100 ppm thereafter by suitable additions of iron to the replenishing solutions.

We claim:

1. In a trivalent chromium electroplating bath of the type which consists essentially of an acidic aqueous solution of trivalent chromium, a carboxylate selected from formate, acetate and mixtures thereof, a bromide and ammonium the improvement which consists in maintaining in said bath an amount of metal ion selected from (i) iron or nickel in the amount of between 30 and 150 parts per million of the solution by weight, or (ii) iron plus nickel in the amount of between 30 and 150 ppm with the nickel being in an amount up to about 100 ppm.

2. The bath of claim 1 consisting essentially of:
   a. from 0.1 to 1.2 molar trivalent chromium;
   b. from 0.05 to 0.5 molar bromide;
   c. from 0.5 to 3 moles of a carboxylate selected from formate and mixtures thereof with acetate;
   d. from 0.2 molar to saturation of ammonium ion;
   e. from 0.1 molar to saturation of borate;
   f. at least one ion selected from chloride and sulphate in a concentration of from 1 molar to saturation;
   g. said metal ion;
   h. from 0.5 molar to saturation of ion selected from sodium and potassium;
   i. said bath having a pH of between 1 and 4.

3. The bath of claim 2 containing from 30 to 150 parts per million of iron.

4. The bath of claim 2 containing from 30 to 150 parts per million of nickel.

5. The bath of claim 2 containing from 30 to 150 parts per million of iron plus nickel with nickel being in an amount up to about 100 parts per million.

6. The bath of claim 2 containing from about 40 to 100 parts per million of iron plus nickel.

7. The bath of claim 2 containing from about 40 to 100 parts per million of iron.

* * * * *